US010058719B2

(12) United States Patent
Lin

(10) Patent No.: US 10,058,719 B2
(45) Date of Patent: Aug. 28, 2018

(54) BREAKING DEVICE

(71) Applicant: GENERAL STAR CORP., New Taipei (TW)

(72) Inventor: Tsai-Wang Lin, Changhua (TW)

(73) Assignee: GENERAL STAR CORP., New Taipei (TW)

( * ) Notice: Subject to any disclaimer, the term of this patent is extended or adjusted under 35 U.S.C. 154(b) by 0 days.

(21) Appl. No.: 15/623,822

(22) Filed: Jun. 15, 2017

(65) Prior Publication Data

US 2018/0147423 A1 May 31, 2018

(30) Foreign Application Priority Data

Nov. 29, 2016 (TW) ..... 105218199 U

(51) Int. Cl.
*A62B 3/00* (2006.01)
*F41B 15/02* (2006.01)

(52) U.S. Cl.
CPC ..... *A62B 3/00* (2013.01); *F41B 15/02* (2013.01)

(58) Field of Classification Search
None
See application file for complete search history.

(56) References Cited

U.S. PATENT DOCUMENTS 5,188,362 A * 2/1993 Ashihara ..... F41B 15/025 463/47.6
5,491,898 A * 2/1996 Riley ..... A62B 3/005 30/295
6,139,165 A * 10/2000 Crowe ..... F21V 33/0064 362/102
6,418,628 B1 * 7/2002 Steingass ..... A62B 3/005 30/366
6,499,855 B1 * 12/2002 Kukuk ..... F21V 33/0064 362/102
2005/0120563 A1 * 6/2005 Lin ..... A62B 3/005 30/123
2008/0316737 A1 * 12/2008 Summers ..... F21L 4/005 362/202
2010/0301088 A1 * 12/2010 Purdy ..... A62B 3/005 225/103
2014/0239023 A1 * 8/2014 Tyybakinoja ..... A45F 5/021 224/197
2018/0066915 A1 * 3/2018 Cheng ..... F41B 15/022

* cited by examiner

*Primary Examiner* — Tramar Harper
(74) *Attorney, Agent, or Firm* — Egbert Law Offices, PLLC

(57) ABSTRACT

An improved breaking device, which has a base, a breaking bolt, an elastic element and a conical head, wherein, the base connects to the body at one end, the conical head is linked with the base and the elastic element and breaking bolt are installed in the conical head. Therefore, the breaking device with the above-mentioned elements is used in combination with baton and breaker to smash windows, and yet, when the breaking device is not used for this purpose, the breaking bolt is hidden in the conical head to avoid scratching any persons or articles and ensure user safety.

4 Claims, 6 Drawing Sheets

BREAKING DEVICE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to an improved breaking device, and more particularly to a breaking device of application safety, which is used in combination with a baton and breaker to smash windows, and yet, when the breaking device is not used for this purpose, the breaking bolt of the breaking device is hidden in the conical head to avoid scratching any persons or articles and ensure user safety.

2. Description of Related Art Including Information Disclosed Under 37 CFR 1.97 and 37 CFR 1.98

Law-enforcement officers, guards and community patrols often face unpredictable physical conflicts and emergencies on duty and they usually carry batons for self-defense. However, if any emergency arises, they must immediately enter a house or a car and rush to emergency rescue by smashing door or car windows. Since most door or car windows are made from reinforced glass, they will probably miss the perfect rescue time if they spend a minute searching for a window breaker to smash the windows; therefore, in most cases, batons are used to smash door or car windows for the sake of convenience. However, because the conventional batons have no functions of breakers, it is time consuming the ineffective in such occasions and usually delays the rescue time; besides, in the smashing process, the shards of glass are likely to bounce off and hurt the rescuers due to any improper application of force, which is also a troublesome problem.

Thus, relevant practitioners have developed a baton 8 as shown in FIG. 1, namely, installing a breaking device 9 in the end of the baton 8. The breaking device 9 has a sharp hammer 91 at the front end, which enables the breaking function of the baton 8. Hence, in emergency rescue, it can be used for smashing door or car windows; however, the baton 8 still has limitations. When not in use, the baton 8 is usually hung on the girdle of a uniform and the sharp hammer 91 is highly likely to cause injury or damage to articles (e.g. clothes, desks and chairs). It is unsafe.

To overcome the shortcomings of the conventional design, although the applicant's previous breaking device (application number: 105214300) as a utility model patent fails to overcome these shortcomings, it can be put into normal use without major problems. However, in case of improper manual operation, the breaking bolt is difficult to collapse or extend smoothly. Despite this minor deficiency that can be remedied by adjusting the dimensions of elements, the applicant, to achieve perfect condition of invention, has been continuously working on refinements of the invention in order to ensure flawless use of the invention.

BRIEF SUMMARY OF THE INVENTION

Based on the foregoing, the inventor of the present invention, after continuous research and improvement, has eventually designed the present invention, namely, the improved breaking device, which is the purpose of the present invention, relating to a breaking device of application safety and used in combination with baton and breaker to smash windows, and yet, when the breaking device is not used for this purpose, the breaking bolt of the breaking device is hidden in the conical head to avoid scratching any persons or articles and ensure user safety.

To meet the purpose of the present invention, the improved breaking device is comprised of a base, a breaking bolt, an elastic element and a conical head, wherein:

- the base has the first binding site on one end, a body combined with the first binding site, a registration site on the other end of the base, the registration site having a sliding section and the first thread section;
- the breaking bolt has a sharp conical tip on the front end, the outer periphery of the breaking bolt being linked with the elastic element;
- the conical head is linked with the registration site of the base, the conical head having a conical surface on the front side, the conical surface including a hole in the middle, the hole connecting to a holding hole in the conical head, the holding hole including the second limit section and being designed for insertion of the breaking bolt and elastic element, the conical head being supported and pushed by the elastic element to maintain the normal forward state, and the breaking bolt being hidden in the holding hole without exposure;
- said first binding site has the first thread section, the body having the second binding site, the second binding site including the second thread section, the first thread section and the second thread section interlocking with each other;
- said body is a baton, the breaking device being installed in the tail end of the body;
- said breaking bolt has a retaining lip at the back end; and
- said body is a breaker grip.

DETAILED DESCRIPTION OF THE INVENTION

Figure 1:
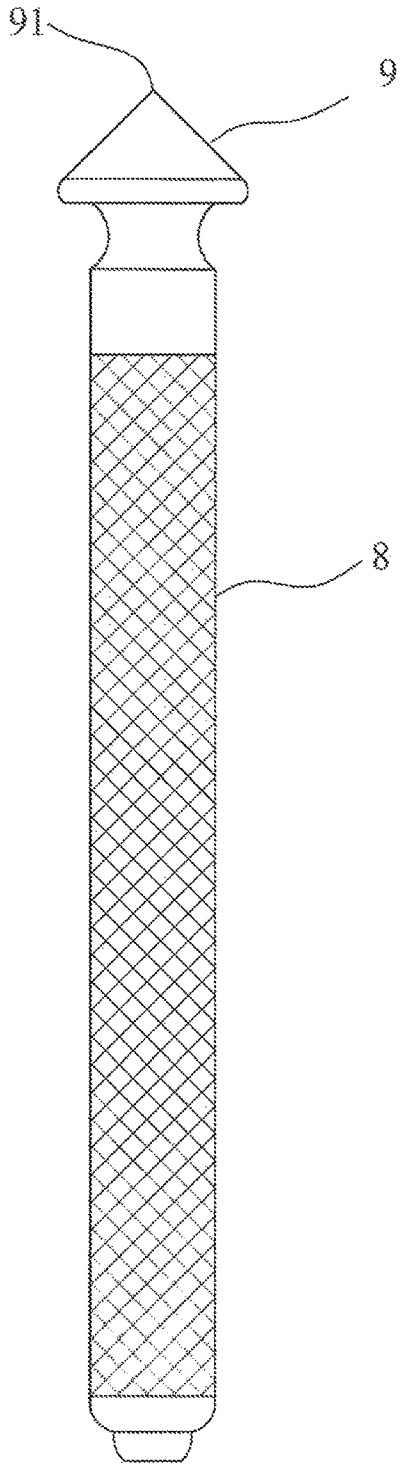
FIG. 1 is a schematic diagram of the baton of the conventional breaking device.
Figure 2:
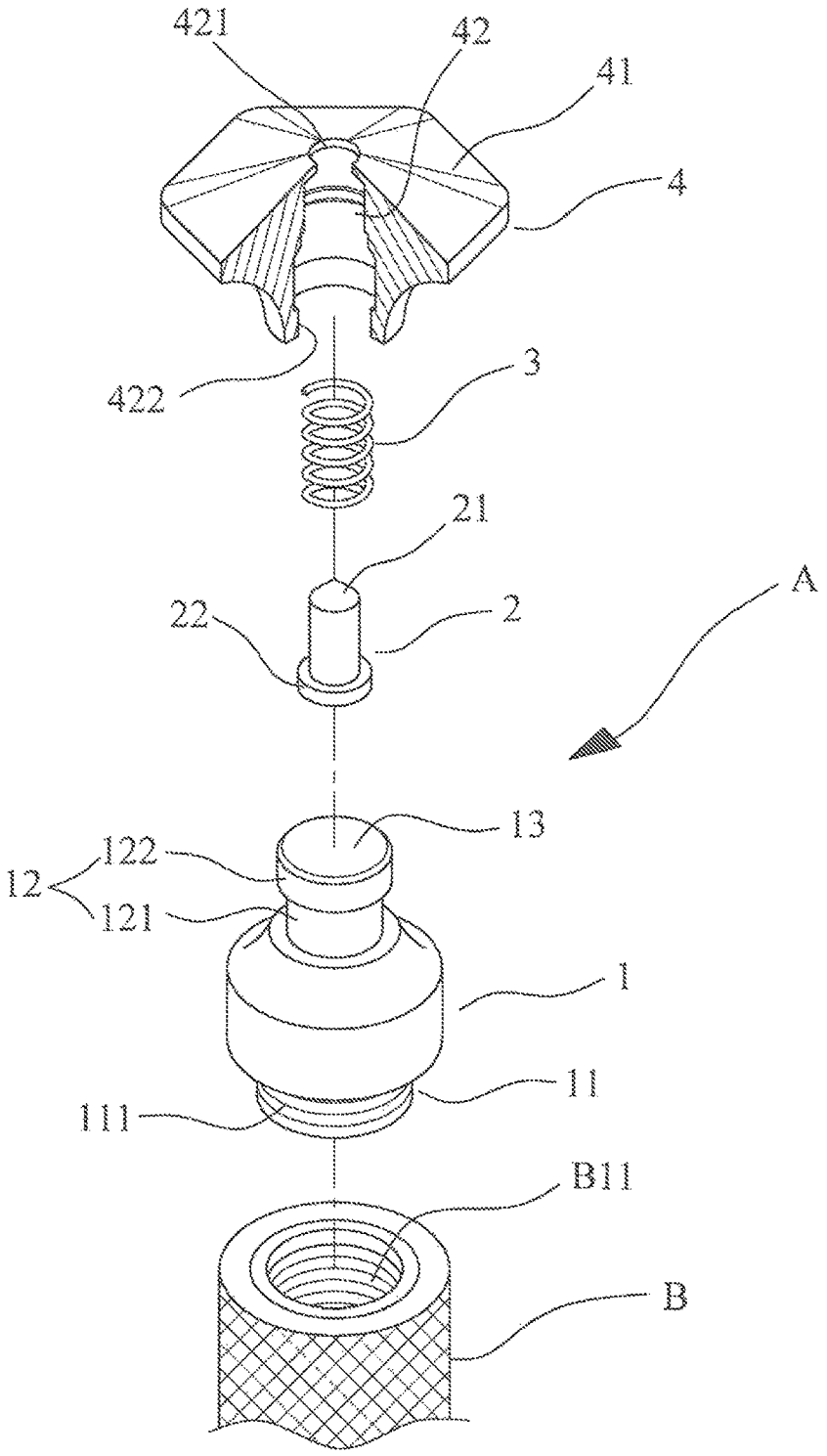
FIG. 2 is the exploded pictorial diagram of the present invention.
Figure 3:
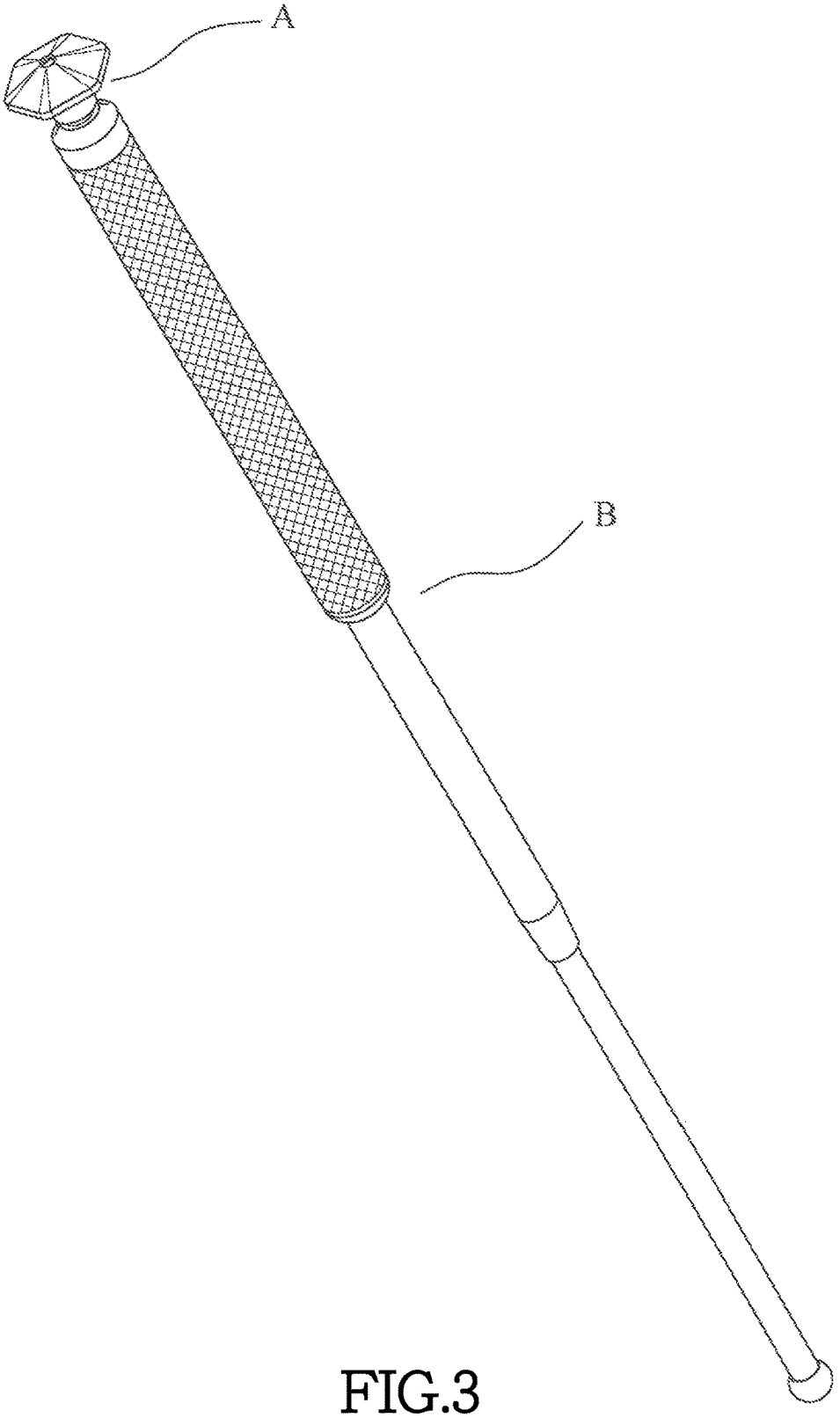
FIG. 3 is the stereogram of the present invention being applied to a baton.
Figure 4:
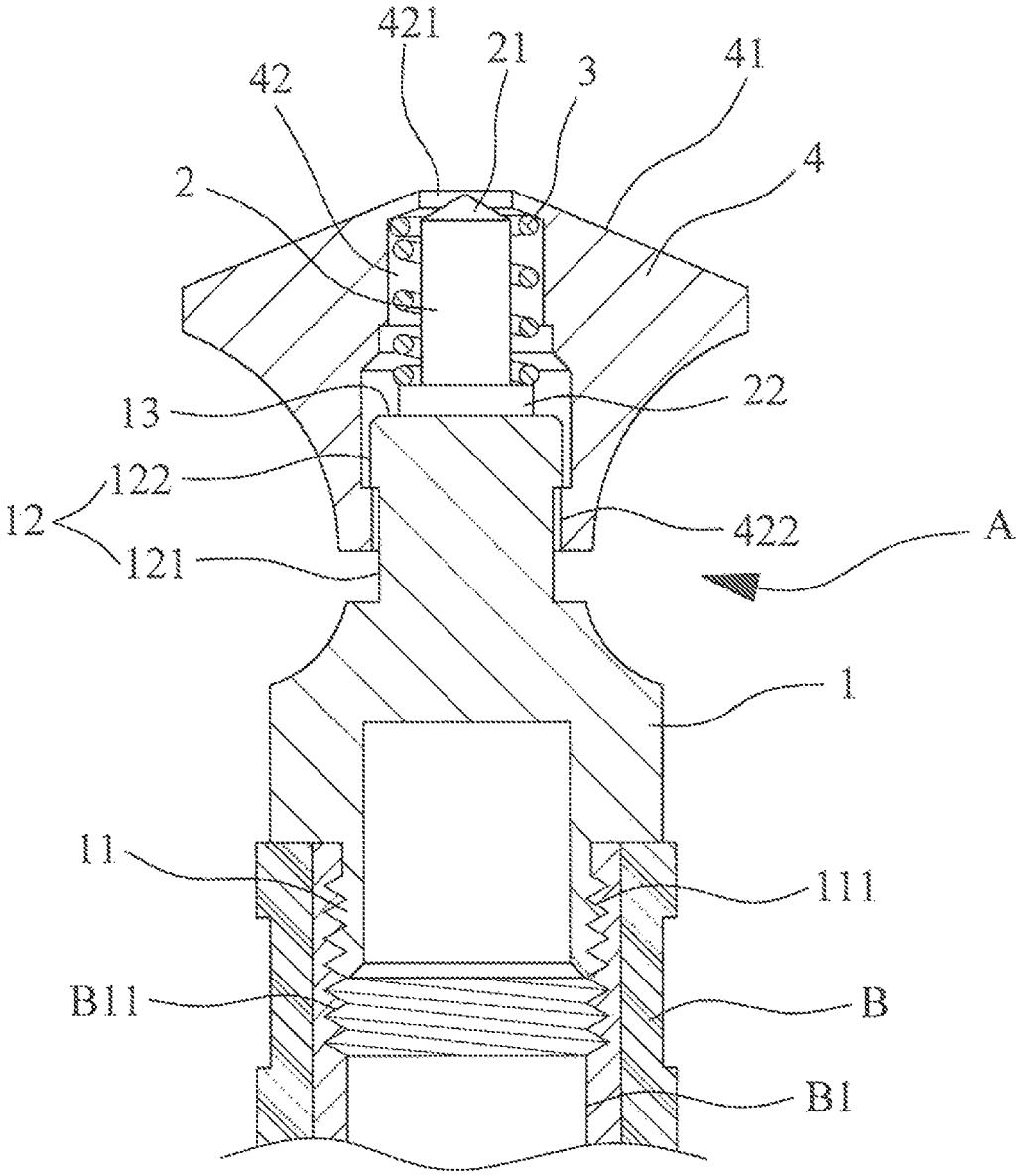
FIG. 4 is the section view of the assembly of the present invention.

As shown in FIGS. 2 to 4, the breaking device A of the present invention is comprised of a base 1, a breaking bolt 2, an elastic element 3 and a conical head 4.

The base 1 has the first binding site 11 on one end, a body B combined with the first binding site 11, a registration site 12 on the other end of the base 1, the registration site 12 having a sliding section 121 and the first limit section 122.

The breaking bolt 2 has a sharp conical tip 21 on the front end, and a retaining lip 22 at the back end of the breaking bolt 2, the retaining lip 22 being supported by the front face 13 of the registration site 12 at the bottom.

The conical head 4 is linked with the registration site 12 of the base 1, the conical head 4 having a conical surface 41 on the front side, the conical surface 41 including a hole 421 in the middle, the hole 421 connecting to a holding hole 42 in the conical head 4, the holding hole 42 having the second limit second 422, and the breaking bolt 42 and the elastic element 3 being inserted in the holding hole 42, the elastic element 3 being linked with the outer periphery of the breaking bolt 2.

Said first binding site 11 has the first thread section 111, the body B having the second binding site B1, the second binding site B1 including the second thread section B11, the first thread section 111 and the second thread section B11 interlocking with each other.

Said body B is a baton (as shown in FIG. 3), the breaking device A being installed in the tail end of the body.

As shown in FIG. 4, during assembly of the breaking device A of the present invention, the first thread section 111 of the first binding site 11 of the base 1 interlocks with the second thread section B11 of the second binding site B1 of the body B to fix the base 1 onto the body B. Then, the breaking bolt 2 and the elastic element 3 are inserted into the holding hole 42, the elastic element 3 being linked with the outer periphery of the breaking bolt 2 to link the breaking bolt with the base 1. Lastly, the conical head 4 is linked with the registration site 12 of the base 1 to ensure that the first limit section 122 completely passes through the second limit section 422 and is closely connected to the second limit section 422 without falling, in which way, the conical head 4 can only move back and forth along the sliding section 121 of the registration site 12. The back end of the elastic element 3 is supported by the front surface 13 of the registration site 12 with the front top of the elastic element 3 against the front edge of the holding hole 42 of the conical 4 so that the conical head 4 supported by the elastic element 3 can maintain the forward state and the breaking bolt 2 can be hidden in the holding hole 42 without exposure, in which way, the sharp conical tip 21 will not extend to scratch any persons or articles, ensuring the use safety.

Figure 5:
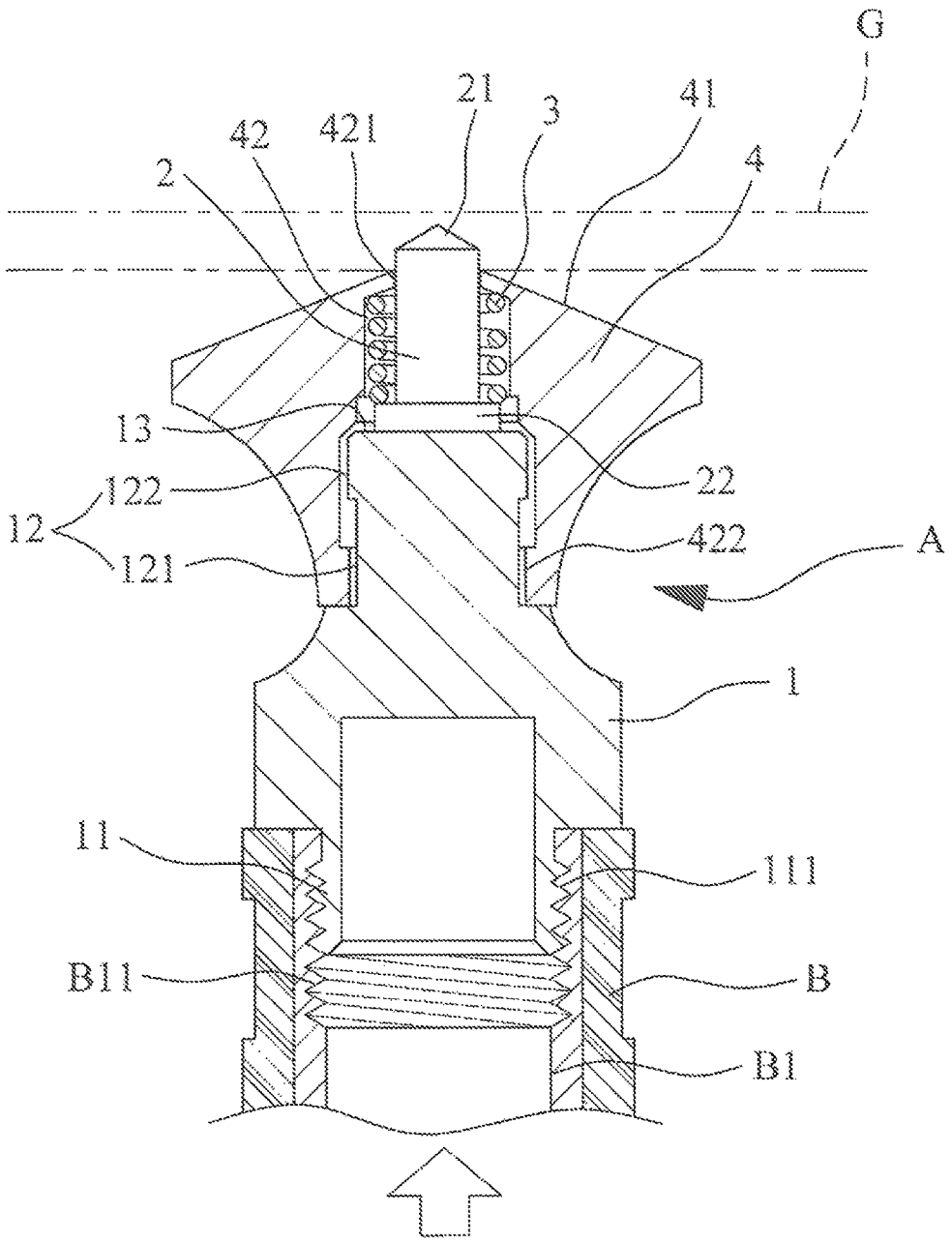
FIG. 5 is the action sketch of the present invention.

FIG. 5 is the action sketch of the present invention. When using the breaking device to smash a door or car window glass G, the conical surface 41 of the conical head 4 of the breaking device A hits the surface of the glass G. During application of force, the conical head 4 touches the surface of the glass G and slides back to press the elastic element 3, and then, the sharp conical tip 21 of the breaking bolt 2 extends out of the hole 421 and smash the glass G. Because the inertial force exceeds the bearing capacity of the glass G, the great force generated instantly breaks the surface of the glass G, making it easier and safer to quickly smash a door or car window and ensuring rescue without delay.

Figure 6:
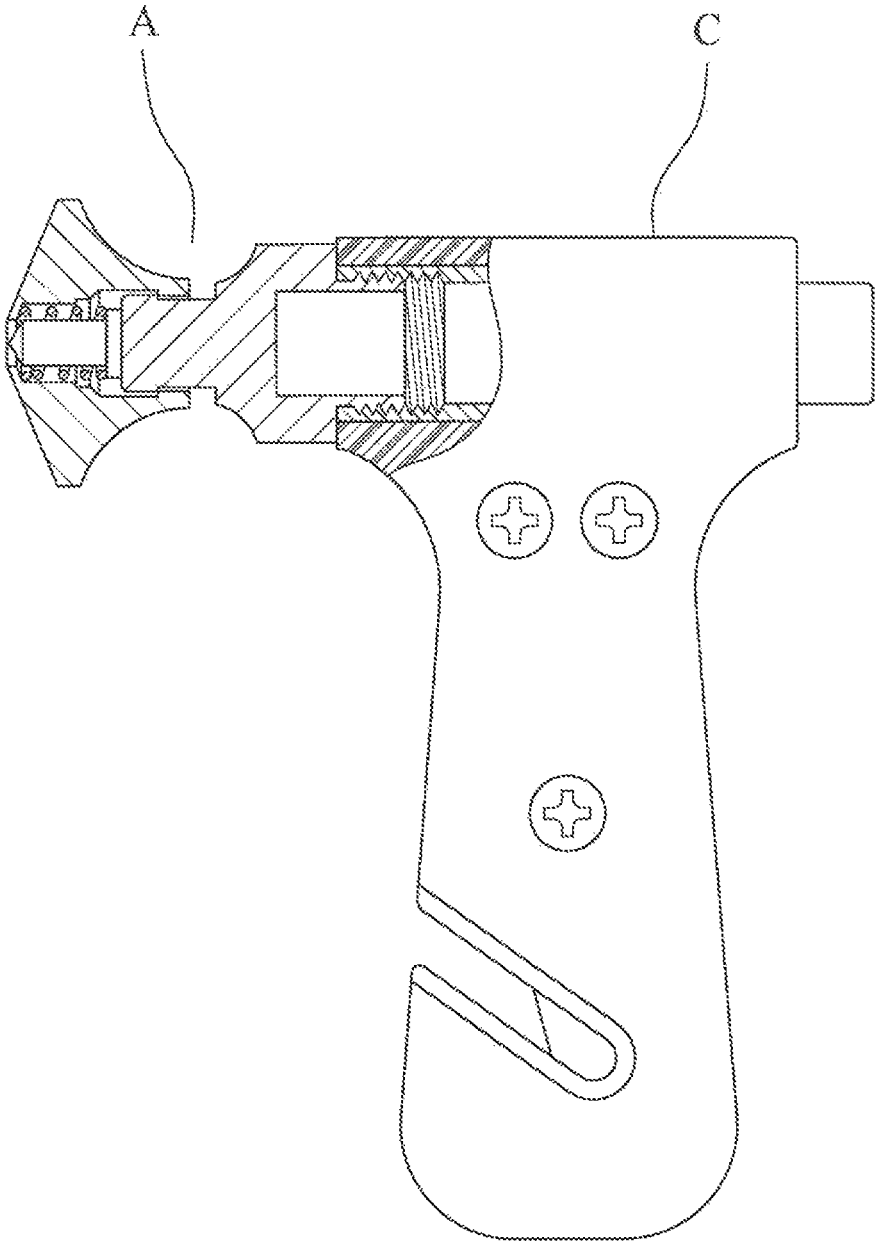
FIG. 6 is an embodiment of the breaker of the present invention.

FIG. 6 is an embodiment of the breaker of the present invention, wherein, the breaking device A of the present invention is fixed onto the front side of the body C and the body C is a breaker grip.

To summarize, the breaking device of the present invention is used in combination with baton and breaker for smashing door and car windows. When not in use, the breaking bolt is hidden in the conical head to avoid scratching any persons or articles and ensure user safety. Therefore, the existing shortcomings of the conventional breaking device are overcome with a new technology of the present invention, proving the novelty and progressiveness of the present invention as a utility model patent.

The embodiment provided by the present invention is only used to explain the technology of the present invention, but does not attempt to, impose any form of restrictions to the present invention with said embodiment, and therefore, where there is made in the spirit of the invention and the following claims under the same in relation to any changes to the present invention, all should still include in the scope of the present invention.

I claim:

1. A breaking device comprising:

a base having a first binding site at one end thereof, said base having a registration site at an opposite end of said base, said registration site having a sliding section and a first limit section at said opposite end of said base;

a body joined to said first binding site of said base;

a breaking bolt having a sharp conical tip at one end thereof, an opposite end of said breaking bolt bearing against said opposite end of said base;

a conical head having a conical surface at an outer end thereof, said conical head having a hole formed centrally of said conical surface, said conical head having a holding hole formed therein, said conical head having a second limit section formed at an opposite end thereof, said second limit section defining an opening at an opposite end of said conical head, said sliding section of said base extending through said opening such that said first limit section of said base resides in said holding hole, said first limit section having a diameter greater than a diameter of said opening, said breaking bolt residing entirely within said holding hole of said conical head, said sharp conical tip facing said hole in said conical surface; and an elastic element bearing against a retainer lip at said opposite end of said breaking bolt so as to urge said breaking bolt away from said hole of said conical surface, a movement of said bolt in a direction towards said conical head causing said breaking bolt to move toward and through said hole of said conical surface of said conical head.

2. The breaking device of claim 1, said first binding site having a first thread section, said body having a second binding site, said second binding site having a second thread section, said first thread section engaged with said second thread section.

3. The breaking device of claim 1, said body being a baton.

4. The breaking device of claim 1, said body being a breaker grip.

* * * * *